United States Patent [19]

Todd

[11] Patent Number: 5,018,975

[45] Date of Patent: May 28, 1991

[54] EDUCATIONAL AMUSEMENT DEVICE WHICH INCLUDES A GAME CARD, AND METHOD FOR USING THE GAME CARD

[76] Inventor: Alan B. Todd, 2500 N. Vernon St., Arlington, Va. 22207

[21] Appl. No.: 582,427

[22] Filed: Sep. 14, 1990

[51] Int. Cl.[5] ..... G09B 19/00

[52] U.S. Cl. ..... 434/128; 434/177; 273/272

[58] Field of Search ..... 434/177, 167, 128; 273/272, 153 R; 283/49

[56] References Cited

U.S. PATENT DOCUMENTS

| | | | |
|---|---|---|---|
| 1,629,601 | 5/1927 | Trbojevich | 434/177 X |
| 3,877,703 | 4/1975 | Pierre | 273/272 X |
| 3,941,388 | 3/1976 | Isaac et al. | 273/243 |
| 4,209,173 | 6/1980 | Curtis et al. | 273/272 X |
| 4,350,342 | 9/1982 | Barulich | 273/272 X |
| 4,512,581 | 4/1985 | Levine | 434/117 X |
| 4,619,457 | 10/1986 | Small | 273/269 |

FOREIGN PATENT DOCUMENTS

| | | | |
|---|---|---|---|
| 465979 | 5/1937 | United Kingdom | 434/177 |

OTHER PUBLICATIONS

"Washington Daily News"; Mar. 20, 1967; p. 52.
"4Cyte", Advertisement; *Playthings;* Oct., 1963; p. 20.
"Boggle"; Parker Brothers; 1973.

*Primary Examiner*—Richard J. Apley
*Assistant Examiner*—Rachel M. Healey
*Attorney, Agent, or Firm*—Spencer & Frank

[57] ABSTRACT

A game card includes a playing matrix with squares arranged in rows and columns. Starter words or starter letters may be pre-printed in the playing matrix. The player examines advertisements to derive words which are to be inserted in the playing matrix. Aligned with the rows of the playing matrix are spaces for the player to identify the sources of the advertisements or for the sources to be identified to the player. A word completion matrix aligned with the rows of the playing matrix is provided to receive the terminal portions of any words that are too long for the playing matrix. After the player has completed the playing matrix he examines it in an attempt to find the maximum number of row words in the rows of the playing matrix and the maximum number of column words in the columns of the playing matrix. The game card additionally includes a row word scoring region and a column word scoring region to guide the player in determining a row total and a column total, which are then combined into a game score. The game score depends both on the player's word knowledge and artful selection of words derived from the advertisements and the player's verbal agility in identifying words in the rows and columns of the playing matrix. The game card may be combined with a periodical such as a magazine to provide an educational amusement device, but it may also be used with other forms of advertising such as television commercials.

20 Claims, 2 Drawing Sheets

EDUCATIONAL AMUSEMENT DEVICE WHICH INCLUDES A GAME CARD, AND METHOD FOR USING THE GAME CARD

BACKGROUND OF THE INVENTION

The present invention relates to an educational amusement device which includes a game card in combination with a publication, such as a magazine having pages with advertisements which are used to play the game. The invention also relates to a method for using a game card in a word game which employs advertisements as a component part, regardless of whether the advertisements are presented in a publication or another medium, such as television. As used herein, the term "game" also means "contest" if the game is played competitively by different players.

What might be called "reader's time" is probably the most valued goal sought by advertisers in printed publications such as magazines. Similarly, "viewer's time" is sought by television advertisers, "listener's time" is sought by radio advertisers, and so forth. Vast amounts of money are spent on advertisements in various media in an attempt to persuade consumers to use the advertised products or services, but in our advertising-saturated society many consumers tend to skim over or pay scant attention to advertisements in any of the media. As a result there is a constant quest in the advertising business to devise fresh advertisements which will present the merits of a product or service to the consuming public in an entertaining or otherwise memorable manner.

Word games of various types have long been enjoyed as a relatively cerebral way to provide entertainment. Crossword puzzles are a familiar example. In a crossword puzzle a matrix of squares is provided along with a set of definitions or other guides to words which are to be inserted by a player to complete the puzzle. The popular word game "Scrabble" also relies on a matrix of positions, but in this case players draw playing pieces which are then deposited on the matrix to form words. In another type of word game, groups of letters are dissected to identify different words. For example a school teacher in the elementary grades might deaden the pain of a spelling lesson by presenting a contest in which the members of her class are asked to consider an assigned word and decompose it into the maximum number of smaller words.

SUMMARY OF THE INVENTION

An object of the invention is to enhance the effectiveness of advertisements in any form of media while at the same time providing an interesting and educational type of amusement to the player.

Another object of the invention is to provide a way to coax the consuming public into spending more time considering advertisements.

Another object of the invention is to provide a game card which is used with broadcast or printed advertisements to provide educational amusement to the public.

Another object of the invention is to provide an educational amusement device which includes a publication such as a magazine in combination with a game card which is used by a player in conjunction with advertisements in the magazine.

These and other objects which will become apparent in the ensuing detailed description can be attained by providing a game card having a playing matrix which is arranged to provide rows and columns of squares. Starter words or starter letters may be provided in some of the squares. A player examines advertisements to derive words which he inserts in the squares, with the words possibly overflowing into squares of a word completion matrix adjacent the playing matrix. The sources of the advertisements for the words played are identified in a column having suitable spaces aligned with the rows of the playing matrix. The identification of the sources of the advertisements may be left to the player, or the possible sources may be identified for the player before the game. After the player fills out the playing matrix he identifies row words in the rows of the playing matrix and column words in the columns of the playing matrix. The game card includes a row word scoring region which guides the player in determining a row total and a column word scoring region which similarly guides the player in determining a column total. These totals are then combined to provide a game score which the player records on the game card.

DESCRIPTION OF THE PREFERRED EMBODIMENTS

Figure 1:
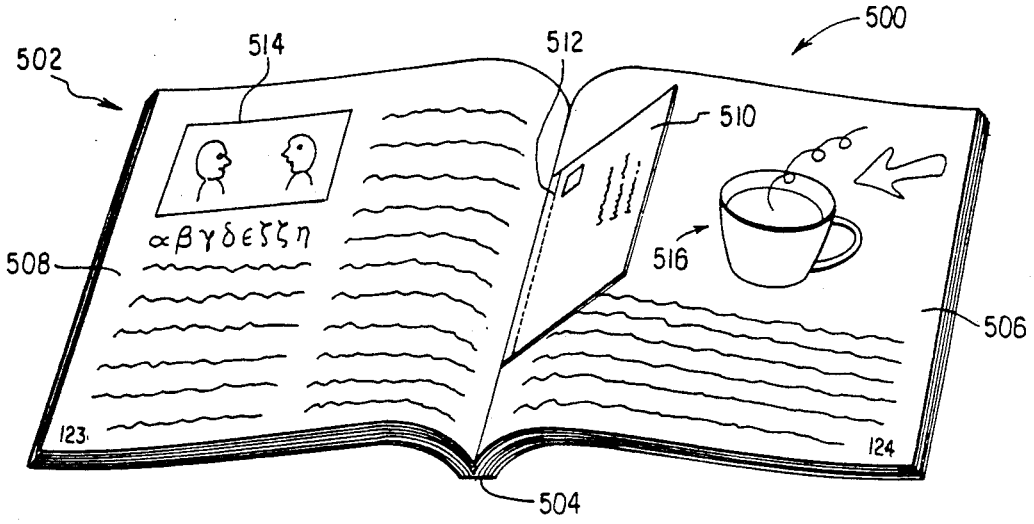
FIG. 1 is perspective view of an amusement device in accordance with the present invention, and shows a magazine in combination with a game card.

An amusement device in accordance with the present invention can be provided in a variety of different forms, one of which is illustrated in FIG. 1. As will be discussed hereafter, the player of such an amusement device records numbers while using the amusement device to play a game in accordance with the method of the present invention, so to avoid confusion the reference numbers used to discuss the amusement device of FIG. 1 will begin at 500. The game in accordance with the method of the invention is a word game, and quotation marks will be used in the following discussion to isolate particular words under discussion.

With reference to FIG. 1, an amusement device 500 includes a publication such as magazine 502 having pages which are bound at a magazine spine 504. These pages include pages with advertising, such as page 506, pages with editorial content (articles, stories, reports, etc.), such as page 508, and possibly pages (not illustrated) with both advertising and editorial content. Amusement device 500 also includes a game card 510 which is bound in with the pages of magazine 502 and which is provided with a line 512 of perforations so that card 510 can be detached from the magazine 502.

The side of card 510 shown in FIG. 1 is configured as a postage-prepaid postcard which is addressed to the publisher of magazine 502 (or other person or organization). The side of card 510 that is not shown in FIG. 1 has a playing surface, which will be discussed in detail below.

With continuing reference to FIG, 1, page 508 includes an illustration 514 and text, shown in the form of Greek letters representing a headline and wavy lines for the body of the text. Page 508 can be identified by a page number (page number 123 in this example). Page 506 depicts a single advertisement with an illustration 516 and text, represented with wavy lines. In this example page 506 bears a page number (here, page number 124), but frequently advertisers prefer to omit printed page numbers. Nevertheless, it will be appreciated that a page number can be attributed to such an advertising page by counting forward or back from pages that are numbered.

Figure 2:
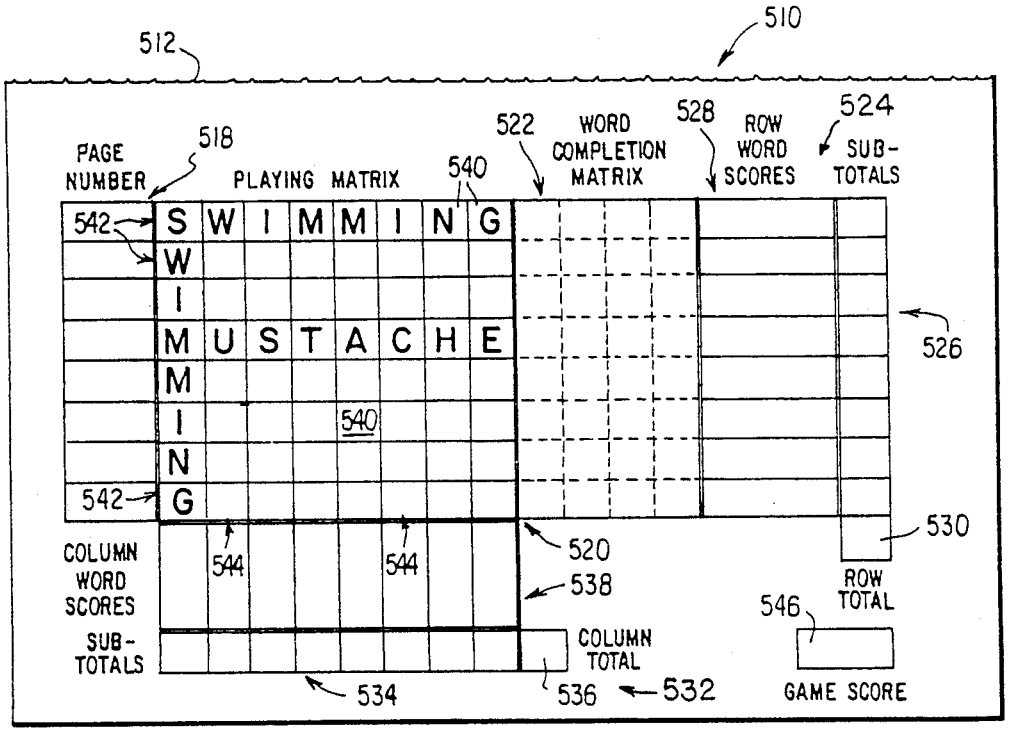
FIG. 2 is a top plan view of the playing surface of the game card shown in FIG. 1.

FIG. 2 illustrates the playing surface of game card 510. The playing surface is pre-printed with a page number identification region or column 518 which is visually distinguished by vertical double lines from a playing region or matrix 520, which in turn is visually distinguished by vertical double lines from a word completion region or matrix 522. Vertical double lines distinguish word completion matrix 522 from a row word scoring region 524, which includes a column 526 of subtotal positions or blocks, a column 528 of elongated regions for receiving information on which the subtotals are based, and a row total block 530. Double vertical lines are used to visually distinguish column 528 of word scoring region 524 from column 526, and double horizontal lines are used to visually distinguish column 526 from block 530. Corresponding to row word scoring region 524 is a column word scoring region 532. Column word scoring region 532 includes a row 534 of subtotal positions or blocks, a column total block 536, and a row 538 of elongated regions for receiving information. Appropriate captions are printed adjacent the various columns, matrices, and rows where appropriate to guide the player in their use. For example, "Page Number" for page number identification column 518, "Playing Matrix" for matrix 520, "Row Word Scores" for column 528, and so forth, are printed on game card 510.

Playing matrix 520 provides an array of positions or blocks 540 which are disposed in rows 542 and columns 544. Similarly, word completion matrix 522 is disposed in rows and columns, with the rows of matrix 522 being aligned with the rows 542 of playing matrix 520. The positions or blocks of page number identification column 518, the elongated regions of column 528, and the subtotal blocks of column 526 are also aligned with the rows 542. The subtotal blocks of row 534 and the elongated regions of row 538 are aligned with the columns 544 of playing matrix 520. The alignment is provided in FIG. 2 by the immediate juxtaposition of the various elements depicted on the playing surface of game card 510, at the same horizontal or vertical position, but it will be apparent other strategies could be employed for associating the rows and columns of playing matrix 520 with the blocks or elongated regions of column 518 and regions 524 and 532.

With continuing reference to FIG. 2, playing matrix 520 is preferably pre-printed with one or more starter words selected by the magazine publisher. In FIG. 2 the publisher has selected two starter words, "swimming" and "mustache." "Swimming" is printed in the first row 542 and in the first column 544. The initial "s" is shared by the first row and the first column. The second starter word, "mustache," is printed at the fourth row 542. The initial "m" of the starter word is shared with one of the m's of "swimming."

After the player has detached game card 510 from magazine 502 at perforations 512, his object is to complete the remaining blocks 540 of matrix 520 in a manner which maximizes the player's row word subtotals and column words subtotals, and thus maximizes the game score recorded in game score block 546. Words for completing playing matrix 520 are based upon and limited to the advertisements in magazine 502, as will be explained in more detail below. It will be apparent that this encourages the player to scrutinize the advertisements in magazine 502, thus increasing the average reader's time garnered by the advertisements. When the player makes an entry in matrix 520 based on an advertisement, he also marks in column 518 the page number of the advertisement on which the entry is based. After the player has completed matrix 520, he identifies row words formed by contiguous groups of letters in each row 542, and column words formed by groups of contiguous letters in each column 544. For the row words, the player awards himself one point for each letter in each word he identifies. For example, the player may identify "swimming", "swim", and "in" in the starter word "swimming" in the first row 542, thus providing a score of 8 (for "swimming") plus 4 (for "swim") plus 2 (for "in") for this row word. These values are recorded by the player in the uppermost elongated region of column 528, and their sum is marked by the player in the uppermost block of column 526. As an example of further game rules which might be established, the single-letter words "a" and "i" cannot be counted. Nor can abbreviations or proper nouns. Contractions which require apostrophes (such as "isn't") are also forbidden. Only words which are present in a standard reference work, such as the current edition of "Webster's New Collegiate Dictionary," can be properly identified. The player does not write "swimming," "swim," and "in" in the upper elongated region of column 528 due to space limitations; instead, he records "8+2+4" or "4+8+2" or so forth. This provides both the number of words that the player has identified and the number of letters in each of these words, and this information can serve as a guide to the actual words identified by the player in the event that the subtotal he records in the top box of column 526 needs to be verified (as might occur during a contest in which prizes are awarded). A player cannot award himself any points, of course, for a word for which he fails to identify. For example, if the player accidentally neglected the word "in" in "swimming," he would simply record "8+4" or "4+8" in the top elongated region of column 528, and give himself a corresponding subtotal of "12" in the top box of column 526.

Improper word identification disqualifies the player's count for such a word. For example, if the player had identified both "in" and "I'm" in the start word "swimming," this circumstance could be detected by the presence of not one but two "2's" recorded in the top elongated region of column 528, and the word "I'm" would be disqualified. The player would also not receive credit in his score of a word if, for instance, he identified in "swimming" the word "Ming" (the name of a Chinese dynasty), since proper nouns (even if used as adjectives) are not allowed. The player would likewise not receive credit if he identified an abbreviation or a word not found in a standard dictionary.

The scoring in column word scoring word region 532 is similar, except that the player awards himself 5 points rather than 1 point for each letter of each word he identifies in the columns 544 of matrix 520. The player marks the sum of his row word subtotals in box 530, the sum of his column words subtotals in box 536, and the sum of the row total and column total in game score box 546.

What has not yet been discussed is word completion matrix 522. In the boxes of this matrix the player records letters of words that are begun in matrix 520 but that cannot be completed in matrix 520. However the letters recorded in matrix 522 are not used in scoring.

It will be recalled that the words entered by the player in matrix 520 are based on advertisements in magazine 502. More particularly, the words which the player is permitted to select are nouns which describe objects depicted in illustrations in advertisements or verbs which depict actions shown in the illustrations in the advertisements. Thus words derived from illustration 514 (FIG. 1) are excluded, since this illustration is part of the editorial content of magazine 502. Illustration 516 is part of an advertisement, and if appropriate the player would be permitted to select the words "cup," "container," "coffee," "liquid," "handle," "arrow," etc. Such words as "hot" or "dark" would not be permitted since they are neither nouns nor verbs. If the illustration in the advertisement had shown a person with his mouth open and the cup poised near his mouth, verbs such as "drinking" would also be available for the player's selection.

Figure 3:
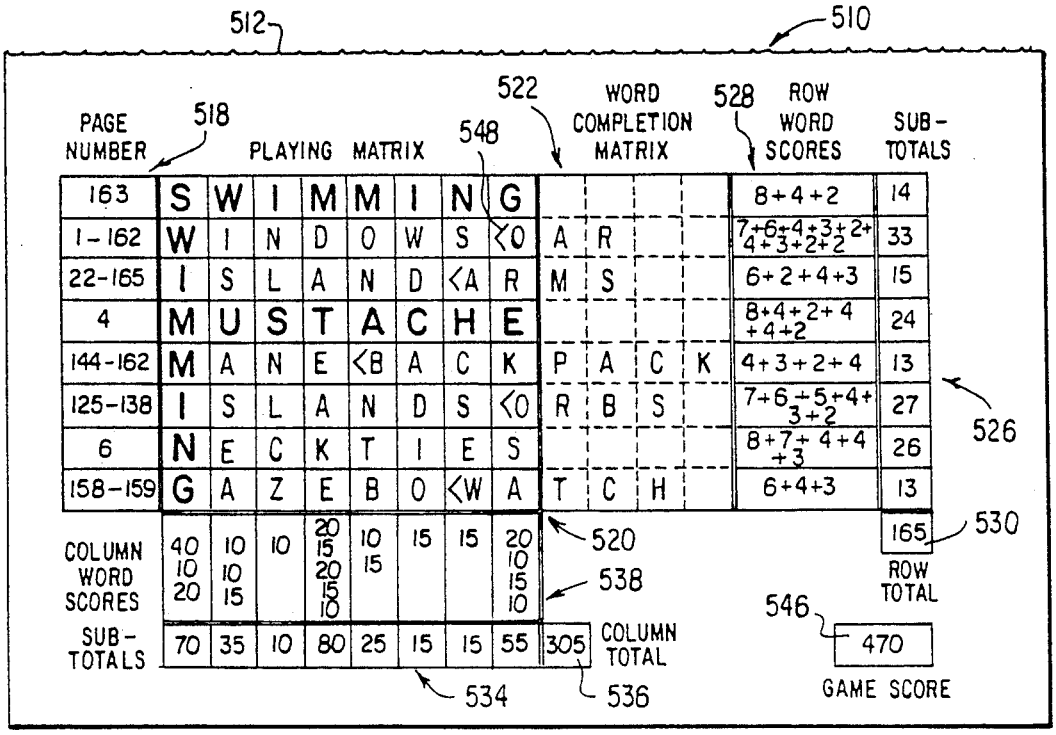
FIG. 3 is an example showing a top plan view of the game card of FIG. 2 after it has been completed by a first player.
Figure 4:
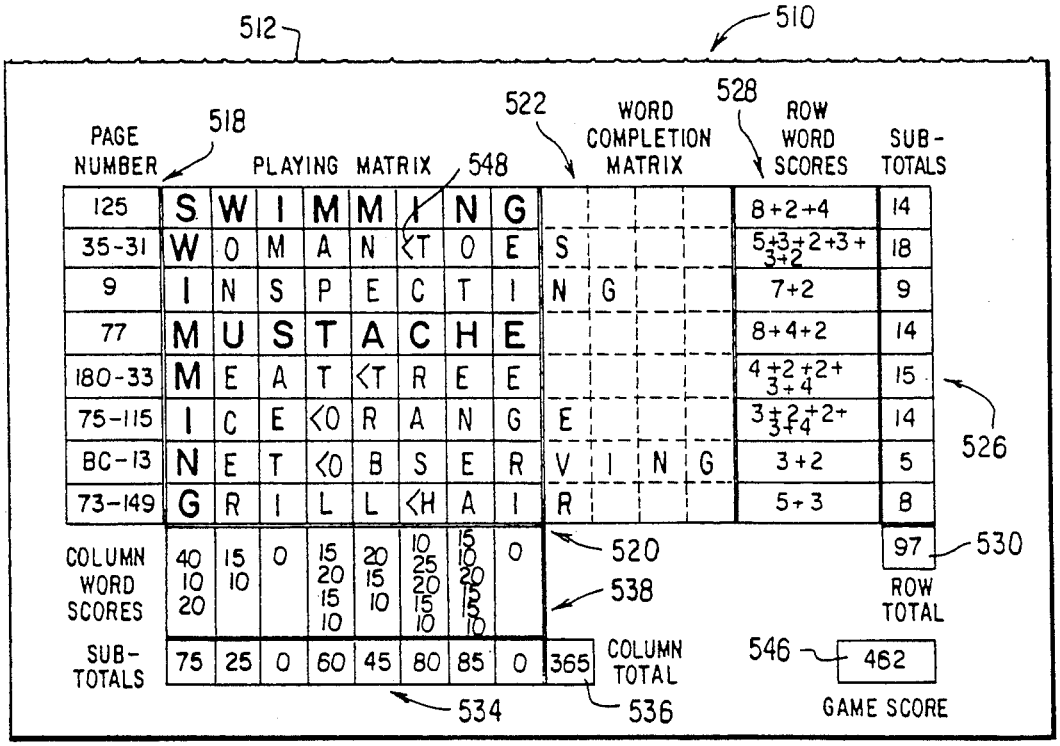
FIG. 4 is an example showing a top plan of the game card of FIG. 2 after it has been completed by a second player.

Now that the rules of this embodiment have been explained, they will be clarified with the aid of the examples in FIGS. 3 and 4. These examples are drawn from the May, 1990 edition of "Smithsonian" magazine, which is incorporated herein by reference. The May, 1990 "Smithsonian" will hereafter be referred to as simply the Magazine, with a capitol M.

The playing surface of card 510 as shown in FIG. 3 has been completed by a player A. With attention first to the pre-printed starter words, player A has detected the activity "swimming" in an advertisement on page 163 of the Magazine, and accordingly he has recorded "163" in the uppermost box of page number identification column 518. The starter word "swimming" completely fills the uppermost row of playing matrix 520, so player A has no need to make entries in the top row of word completion matrix 522. Player A has detected three words in "swimming," and in the top elongated region of column 528 he has recorded the word identification information "8" (for "swimming"), "4" (for "swim"), and "2" (for "in"). Although only nouns and verbs can legitimately be entered into playing matrix 520, there is no such restriction in the word identification phase of the game. Player A has marked the subtotal "14" in the upper box of column 526. Proceeding to the second row of matrix 520, player A had his choice of any object or activity (noun or verb) which is shown in an illustration in an advertisement and which begins with the letter "w." Player A has selected "windows," which are shown in a car illustrated in an advertisement on page 1 of the Magazine. The word "windows" does not completely fill the second row of matrix 520; there is one block left over. Accordingly, player A has placed a word-end bracket 548 in the left-over box and is free to select another noun or verb from the illustrations in the advertisements in the Magazine. The selection of the first word in the row was limited by the presence of the "w" in the starter word "swimming," but there is no such constraint following a word-end bracket 548. Player A has selected an "oar" shown in a boat advertisement on page 162 of the Magazine. Player A has inserted the "o" in the left-over block in the second row of matrix 520, and he has inserted the "ar" in word completion matrix 522. Player A has identified a number of different words in the letters "windowso" he entered into the second row of playing matrix 520. These words are "windows," "window," "wind," "win," "in," "dows," "dow," "do," and "so." Player A has entered the number of letters in each of these words, in no particular order, in the second elongated region of column 528. They add up to 33, which player A has inserted as the row subtotal in the second box of column 526. There are several things to note here. First, player A has not identified "I," since single-letter words are not permitted. However he has counted both "window" and "windows," since each is a separate word. "Dow" and "dows" might be a cause for concern, since proper nouns or adjectives based on them are not permitted ("Dow" is the name of a major corporation), but "dow" is identified as a verb meaning "to be able or capable" in Webster's New Collegiate Dictionary. Finally, the letters "ar" entered into word completion matrix 522 are ignored for purposes of determining the row word subtotal.

With regard to the third row of playing matrix 520, player A has identified an "island" in an advertisement on page 22 of the Magazine, and "arms" on a person shown in an advertisement on page 164. Player A has decomposed island and the first 2 letters of "arms" into four words ("island," "is," "land," and "and"), and recorded a row word subtotal of 15 in the third square of column 526. A man with a "mustache" is shown in an advertisement on page 4 of the Magazine, and player A has identified "mustache," "must," "us," "ache," "tach," and "he" as components of the fourth row in matrix 520. Although abbreviations are not permitted, "tach" is identified in Webster's New Collegiate Dictionary as meaning "tachometer" in its own right. A lion with a "mane" and a "backpack" are respectively shown in advertisements on pages 144 and 162 of the Magazine. This provides "mane," "man," "an," and "back," for a row word subtotal of 15 in the fifth box of column 526. Player A has completed the remaining three rows of matrix 520 in a similar manner. His row word total, entered in box 530, is "165." Turning next to the column words in matrix 520, for the first column player A has identified "swimming," "swim," and "in.+ However each letter of a column word is worth 5 points rather than 1 point, so player A has entered "40, " "10," and "20" in the first elongated region of row 538 and he has entered their sum, "70," in the first box of row 534.

Player A has identified "is," "as," and "sea" in the second column of matrix 520; the single word "in" in the third column; the words "moat," "oat," "teak," "tea," and "at" in the fourth column; the words "on" and "nab" in the fifth column; the single word "cad" in the sixth column; the single word "sew" in the next column; and the words "gore," "go," "ore," and "or" in the last column. Player A's column word subtotal is 305, thus giving a total game score of 470 in game score box 146.

Player B has completed game card 510 as shown in FIG. 4. He has detected the activity "swimming" in an advertisement on page 125 of the Magazine, and has identified the same row words and column words as were identified by player A. However instead of marking "windows" in the second row of playing matrix 520, player B has detected an advertisement on page 35 of the Magazine showing a "woman" floating on a raft near a ship. Following "woman" player B has inserted a word-completion bracket 548, and completed the second row with "toes" shown on a statue in an advertisement on page 31 of the Magazine. Ignoring the terminal "s" extending into the first square of word completion matrix 522, player B has identified the words "woman," "man," "an," "ant," "toe," and "to" in the second row, and entered a row word subtotal of "18" in the second box of column 526. Similarly, other entries which player B has made in playing matrix 520 differ from those shown for player A in FIG. 3. (The "BC" shown in the penultimate box of column 518 for player B stands for the "back cover" of the Magazine.) One thing to note is that player B has not been as successful as player A in finding words in the starter word "mustache." Player B has detected only "mustache" itself, along with "must" and "he." Player B has missed both "ache" and "tach," so in the fourth box of column 526 he has awarded himself a row word subtotal of only "14" instead of the "24" that player A received Player B's game score is 462, a respectable score which player B can be moderately proud of if he played the game for his own amusement. However if the publisher were running a contest and both player A and player B mailed in their playing cards 510, player B would lose to player A.

To pick the top winner in a contest the publisher would sort the game cards 510 to find a relatively small number (say, 10) having the highest game scores recorded in game score box 546. The publisher would then check each of these top-scoring game cards to ensure that the words entered by the respective players in their playing matrices 520 are legitimately based on the advertisements identified in their page number identification columns 518. The publisher would then check the players' respective dissection of the row words and column words, assisted by the values entered in the columns 528 and rows 538. The top-scoring player who survived these checks would be declared the overall winner of the contest.

It will be apparent from the foregoing that amusement devices and game methods of using a game card in accordance with the present invention are subject to many modifications, changes, and adaptations. Some such modifications, changes, and adaptations will be briefly mentioned below.

In the amusement device 500 shown in FIG. 1, the game card 510 is connected to magazine 502 by being bound into it. However game card 510 could be included in magazine 502 as what is known as a free standing insert, which is inserted among the pages of the magazine but not actually bound to it.

It will also be apparent that the starting words "swimming" and "mustache" shown in FIG. 2 were arbitrarily selected by the publisher of the magazine. So were the positions of these starter words in playing matrix 520. The publisher need not use any starter words at all, leaving the players of the game entirely to their own devices. The publisher might alternatively print one or more starter letters (rather than complete words) at various positions in playing matrix 520. Playing matrix 520 itself need not have 8 rows and 8 columns, as illustrated, and need not even be a square matrix.

The game rules discussed above can also be modified. Players may be permitted to count: the single-letter words "a" and "I," for example, or contractions or proper nouns.

While a game based on the method of the present invention has been described with reference to magazine advertising, the method is also applicable to other forms of advertising. For example the managers of a television station might distribute game cards similar to that shown in FIG. 2 to the station's viewers. Instead of captioning column 518 "Page Number," the managers might supply the caption "Time Period." Column 518 might also be partially filled-in to identify particular programs by name, or different time slots on the evening of a particular day. For example, the boxes in the column might be pre-printed with the time slots "5:30-6:00," "6:00-6:30," "6:30-7:00," and so forth. Rather than selecting nouns and verbs based on the advertisements the viewers might be required to identify the advertisers or the advertised products by name (such as "Ford" trucks, "Tropicana" juice, and so forth) in the playing matrix 520. This would not only make it easier for station personnel to check that the top-scoring contestants filled in their playing matrices 520 in an accurate manner, it would also stress brand name recognition in the minds of the viewing public. Studies have shown that even memorable advertisements with high viewer recognition may not adequately funnel customers to the advertised product. Since clocks in different households may not be set with extreme accuracy, to avoid squabbles it would be appropriate for the station to permit advertisements that are broadcast at either the hourly or half hourly marks to be used with either of the adjoining time slots.

It will also be apparent that the scoring can be modified in many ways. For example the row word total might be based on less than all of the subtotals; the worst substotal might, for instance, be dropped. The column word scores might be based on some value other than a multiple of 5 with respect to the row word scores. Bonus points could be awarded if a player fills out: his playing matrix 520 in such a manner that he can identify row words or column words having particular letters, such as ten bonus points for a word with an "x" in it. Furthermore players might be permitted to fill out the playing matrix 520 using a "wild card" character such as "*" in place of one or more particular letters. For example the starter word "mustache" in FIG. 2 might be printed "must*che." The player would then be required to identify in column 518 an advertising page which shows a mustache or any other noun or verb which can be formulated by selecting any letter for the "*." In compensation, the player would be able to use the asterisk for any letter he selects while identifying the column words in the column in which the asterisk appears.

Players need not be restricted to nouns and verbs while filling out playing matrix 520. Or nouns alone could be used. Furthermore players need not be restricted to using only the illustrations in advertisements. Instead, they could be permitted to base their entries on the text of the advertisements, or on the text plus illustrations. Players might also be permitted to use only full-page, color advertisements. This option would undoubtedly be attractive to the major advertisers in a magazine, since it would concentrate the reader's time on their advertisements.

Finally, it will be apparent that word completion matrix 522 need not be provided. Players could be allowed to enter only one word in each row of playing matrix 520. Some players might select long words to maximally utilize the squares in playing matrix 520 while other players might prefer to select short words and, if the rules of the contest permit, position the short words laterally within the rows so as to maximize the column word scores.

From the foregoing description it will be apparent that the present invention not only provides entertainment to the players, it also uses advertisements as a component of an amusement device or as a feature in a game-playing method, and thereby amplifies the productivity of advertising dollars by increasing the players' attention to advertising. It also enhances the players' use and knowledge of words, thus providing an interesting and stimulating form of education in word-use of the English language.

I claim:

1. A method for using a game card by a player who is exposed to advertisements, the game card including a matrix of playing positions which are disposed in rows and columns, said method comprising the steps of:

(a) marking words derived from the advertisements in the playing positions of the rows or columns of the matrix;

(b) identifying row words formed by contiguous letters in the rows of the matrix;

(c) recording row word subtotals based on values given to the row words identified in step (b);

(d) identifying column words formed by contiguous letters in the columns of the matrix;

(e) recording column word subtotals based on values given to the column words identified in step (d);

(f) determining a game score based on at least some of the row word subtotals and the column word subtotals; and (g) specifying the sources of said advertisements from which said words were derived on said game card.

2. The method of claim 1, wherein the game card additionally includes a word completion matrix adjacent the matrix of playing positions, and further comprising the step of inserting in the word completion matrix the terminal portions of any words that were begun in the matrix of playing positions but that are too long to be completed within the matrix of playing positions.

3. The method of claim 2, wherein the game card additionally includes a row word scoring region, and further comprising the step of inserting marks, in the row word scoring region, which provide information about the row words identified in step (b).

4. The method of claim 3, wherein the game card additionally includes a column word scoring region, and further comprising the step of inserting marks, in the column word scoring region, which provide information about the column words identified in step (d).

5. The method of claim 4, wherein the advertisements are printed in a publication having a plurality of advertisements, and further comprising the step of selecting from the plurality of advertisements those advertisements from which the words marked in step (a) were derived, and wherein step (g) is conducted by inserting marks on the playing card to identify which advertisements were selected.

6. The method of claim 1, wherein the advertisements are included in programs that are transmitted by a broadcasting station, and further comprising the step of receiving the programs.

7. The method of claim 1, further comprising the step of selecting from a plurality of advertisements those advertisements from which the words marked in step (a) were derived.

8. The method of claim 1, wherein step (f) is conducted by adding all the row words subtotals to provide a row word total, adding all the column words subtotals to provide a column word total, and adding the row word total and the column word total to yield the game score.

9. A method for using an educational amusement device which includes a publication having a plurality of pages with advertisements depicted thereon, and a game card which is inserted in the publication and which includes means for providing a page number identification region having a plurality of identification positions, means for providing a playing region having a matrix of playing positions, the matrix being disposed in rows and columns, with each row of the matrix being aligned with a respective one of the identification positions, the playing positions of at least one of the rows or columns having predetermined letters depicted therein, means for providing a row word scoring region having first subtotal positions, each first subtotal position being aligned with a respective row of the matrix, means for providing a column word scoring region having second subtotal positions, each second subtotal position being aligned with a respective column of the matrix, and means for providing a game score region, said method comprising the steps of:

(a) removing the playing card from the magazine;

(b) selecting advertisements from the magazine;

(c) recording, in the playing positions of the matrix, words which identify features depicted in the advertisements selected in step (b), the predetermined letters being included in the words that are recorded;

(d) in the first subtotal positions, recording subtotal scores for each row of the matrix, the subtotal score which is recorded in each first subtotal position being a function of the number of words and length of the words that the player has identified in the respective row of the matrix;

(e) in the second subtotal positions, recording subtotal scores for each column of the matrix, the subtotal score which is recorded in each second subtotal position being a function of the number of words and the length of the words the player has identified in the respective column of the matrix;

(f) recording a game score which is based on at least one of the subtotal scores recorded in the first and second subtotal positions; and (g) marking the locations of the advertisements selected in step (b) in the identifications positions on said game card.

10. The method of claim 9, wherein the means for providing a row word scoring region additionally includes means for providing elongated regions between the playing region and the first subtotal positions and aligned with the rows of the matrix, and further comprising the step of recording in the elongated regions information about the words the player has identified in the respective row of the matrix.

11. The method of claim 10 wherein the game card additionally includes a completion region between the playing region and the elongated regions of the row word scoring region, the completion region having a matrix of completion positions, the matrix of completion positions being disposed in rows and columns, the rows of the matrix of completion positions being aligned with the rows of the matrix of playing positions, and further comprising the step of recording in the completion positions the terminal letters of words that were started in the playing region but that are too long for completion in the playing region.

12. The method of claim 10, wherein the means for providing a column word scoring region additionally includes means for providing elongated regions, between the playing region and the second subtotal positions and aligned with the columns of the matrix, and further comprising the step of recording in the elongated regions of the means for providing a column word scoring region, information about the words identified in the respective columns of the matrix.

13. An educational amusement device for use by a player, comprising:

a publication having a plurality of pages with advertisements depicted thereon; and a game card removably inserted in the publication, the playing card including:

means for providing a page number identification region having a plurality of identification positions for the player to record the page numbers of advertisements the player has selected, means for providing a playing region having a matrix of playing positions for the player to record words which identify features depicted in the advertisements the player has selected, the matrix being disposed in rows and columns, with each row of the matrix being aligned with a respective one of the identification positions, the playing positions of at least one of the rows or columns having predetermined letters depicted therein and the player including the predetermined letters in the words that the player records, means for providing a row word scoring region having first subtotal positions for the player to record subtotal scores for each row of the matrix, each first subtotal position being aligned with a respective row of the matrix, the subtotal score which the player records in each first subtotal position being a function of the number of words and length of the words that the player has identified in the respective row of the matrix, means for providing a column word scoring region having second subtotal positions for the player to record subtotal scores for each column of the matrix, each second subtotal position being aligned with a respective column of the matrix, the subtotal score which the player records in each second subtotal position being a function of the number of words and length of the words that the player has identified in the respective column of the matrix, and means for providing a game score region for the player to record a game score which is based on at least one of the subtotal scores recorded in the first and second subtotal positions.

14. The educational amusement device of claim 13, wherein the means for providing a row word scoring region additionally comprises means for providing elongated regions, between the playing region and the first subtotal positions and aligned with the rows of the matrix, for the player to record information about the words he has identified in the respective rows of the matrix.

15. The educational amusement device of claim 14, further comprising a completion region between the playing region and the elongated regions of the row word scoring region, the completion region having a matrix of completion positions for the player to record the terminal letters of words that were started in the playing region but that are too long for completion in the playing region, the matrix of completion positions being disposed in rows and columns, the rows of the matrix of completion positions being aligned with the rows of the matrix of playing positions.

16. The educational amusement device of claim 14, wherein the means for providing a column word scoring region additionally comprises means for providing further elongated regions, between the playing region and the second subtotal positions and aligned with the columns of the matrix, for the player to record information about the words he has identified in the respective columns of the matrix.

17. An educational amusement device for use by a player, comprising:

a publication having a plurality of pages with advertisements depicted thereon; and a game card removably inserted in the publication, the playing card including:

means for providing a page number identification region having a plurality of identification positions for the player to record the page numbers of advertisements the player has selected, means for providing a playing region having a matrix of playing positions for the player to record words which identify features depicted in the advertisements the player has selected, the matrix being disposed in rows and columns, with each row of the matrix being aligned with a respective one of the identification positions, means for providing a row word scoring region having first subtotal positions for the player to record subtotal scores for each row of the matrix, each first subtotal position being aligned with a respective row of the matrix, the subtotal score which the player records in each first subtotal position being a function of the number of words and length of the words that the player has identified in the respective row of the matrix, means for providing a column word scoring region having second subtotal positions for the player to record subtotal scores for each column of the matrix, each second subtotal position being aligned with a respective column of the matrix, the subtotal score which the player records in each second subtotal position being a function of the number of words and length of the words that the player has identified in the respective column of the matrix, and means for providing a game score region for the player to record a game score which is based on at least one of the subtotal scores recorded in the first and second subtotal positions.

18. The educational amusement device of claim 17, wherein the means for providing a row word scoring region additionally comprises means for providing elongated regions, between the playing region and the first subtotal positions and aligned with the rows of the matrix, for the player to record information about the words he has identified in the respective rows of the matrix.

19. The educational amusement device of claim 18, further comprising a completion region between the playing region and the elongated regions of the row word scoring region, the completion region having a matrix of completion positions for the player to record the terminal letters of words that were started in the playing region but that are too long for completion in the playing region, the matrix of completion positions being disposed in rows and columns, the rows of the matrix of completion positions being aligned with the rows of the matrix of playing positions.

20. The educational amusement device of claim 18, wherein the means for providing a column word scoring region additionally comprises means for providing further elongated regions, between the playing region and the second subtotal positions and aligned with the columns of the matrix, for the player to record information about the words he has identified in the respective columns of the matrix.

* * * * *